US009808698B2

(12) United States Patent
White

(10) Patent No.: US 9,808,698 B2
(45) Date of Patent: Nov. 7, 2017

(54) KAYAKING TRAINER

(71) Applicant: Douglas Grant White, Edenvale (ZA)

(72) Inventor: Douglas Grant White, Edenvale (ZA)

( * ) Notice: Subject to any disclaimer, the term of this patent is extended or adjusted under 35 U.S.C. 154(b) by 0 days.

(21) Appl. No.: 15/127,836

(22) PCT Filed: Mar. 25, 2015

(86) PCT No.: PCT/ZA2015/000015
§ 371 (c)(1),
(2) Date: Sep. 21, 2016

(87) PCT Pub. No.: WO2015/149086
PCT Pub. Date: Oct. 1, 2015

(65) Prior Publication Data

US 2017/0100655 A1 Apr. 13, 2017

(30) Foreign Application Priority Data

Mar. 25, 2014 (ZA) ..... 2013/07163
Aug. 25, 2014 (ZA) ..... 2014/06176

(51) Int. Cl.
*A63B 69/06* (2006.01)
*A63B 21/015* (2006.01)
(Continued)

(52) U.S. Cl.
CPC ..... *A63B 69/06* (2013.01); *A63B 21/018* (2013.01); *A63B 21/02* (2013.01); *A63B 21/151* (2013.01);
(Continued)

(58) Field of Classification Search
CPC ..... A63B 21/018; A63B 21/02; A63B 21/151; A63B 21/4035; A63B 22/0076;
(Continued)

(56) References Cited

U.S. PATENT DOCUMENTS 4,469,325 A 9/1984 Ware
5,624,357 A 4/1997 Englehart et al.
(Continued)

FOREIGN PATENT DOCUMENTS

WO 9200780 A1 1/1992
WO 2004112918 A1 12/2004

OTHER PUBLICATIONS

International Search Report & Written Opinion issued in the corresponding PCT/ZA2015/000015, Austrian Patent Office, dated Sep. 11, 2015.

*Primary Examiner* — Joshua Lee
(74) *Attorney, Agent, or Firm* — Gottlieb, Rackman & Reisman, P.C.

(57) ABSTRACT

A paddling action simulating exerciser in the form of a kayaking trainer that includes pole, a cord that extends along the pole and linearly displaceably passes therethrough, a hollow spacer that extends between a seating facility and an anchoring layout including a cord guiding layout via which the free ends of the cord are secured to a spring. A multi-directionally adjustable footplate facility that includes an upright foot abutment plate fitted with a heel rest and a toe strap is fitted along the spacer. The spacer, seating facility, leg, footplate facility and guiding layout in constituting a trainer core assembly are laterally rockable by way of rocking formations fitting along slots.

19 Claims, 6 Drawing Sheets

(51) Int. Cl.
*A63B 21/02* (2006.01)
*A63B 21/00* (2006.01)
*A63B 21/018* (2006.01)

(52) U.S. Cl.
CPC .... *A63B 21/4035* (2015.10); *A63B 2069/068* (2013.01)

(58) Field of Classification Search
CPC .... A63B 2022/0079; A63B 2022/0082; A63B 69/06; A63B 2069/062; A63B 2069/064; A63B 2069/068
See application file for complete search history.

(56) References Cited

U.S. PATENT DOCUMENTS

| | | | | |
|---|---|---|---|---|
| 7,270,630 | B1 * | 9/2007 | Patterson ..... | A63B 22/0076 482/121 |
| 7,846,079 | B1 * | 12/2010 | Eaglin ..... | A63B 21/0552 482/121 |
| 2011/0275489 | A1 | 11/2011 | Apau | |

* cited by examiner

KAYAKING TRAINER

BACKGROUND TO THE INVENTION

In house exercising has become a general feature of modern life. The combination of an exercising effort with a training action enhances the value of such pursuit. Kayaking is a sport that involves a variety of bodily actions that take place at the same time that are not easily simulated. It is, amongst others, an object of this invention to provide equipment that extensively simulates a kayak workout even to the extent of permitting a user to make adjustments in numerous areas in benefiting from such workout.

Field of the Invention

This invention relates to a paddling action simulating exerciser. While not so limited the exerciser finds useful application in simulating a kayak paddling action.

Description of the Prior Art

Kayak training equipment known to the applicant often utilise a large fan to provide the workout resistance. This has the effect of rendering such equipment clumsy to transport between locations of use. A system involving a flywheel is also used in providing the required resistance in simulating a kayak paddling operation. The inertia of the flywheel requires a large initiating force at the commencement of a paddling routine that, once running, reduces the effort thus reducing the effectiveness of the exercise. As with the fan utilising variation, the flywheel variation also requires effort to mover between locations of use.

BRIEF DESCRIPTION OF THE DRAWING

The invention is now described, by way of example, with reference to the accompanying drawings. In the drawings

DETAILED DESCRIPTION OF THE DRAWING

Figure 1:
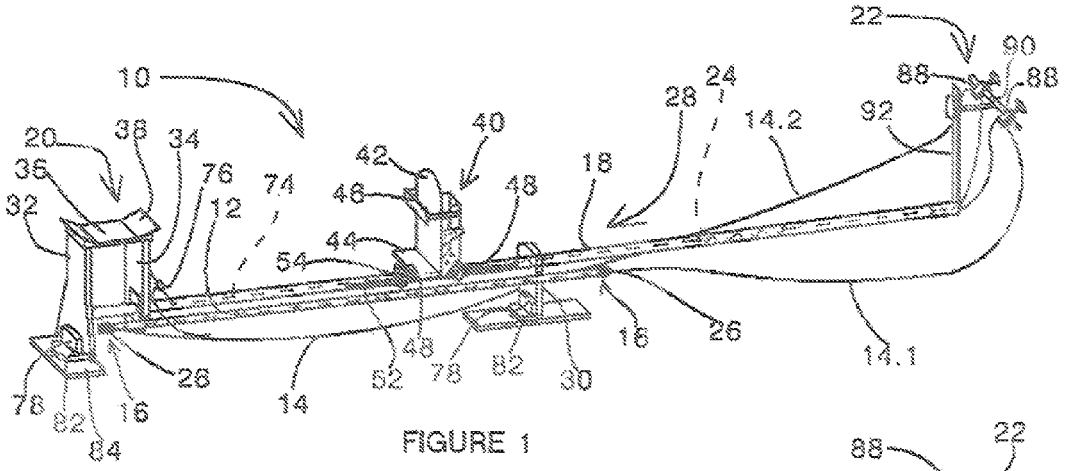
FIG. 1 shows a paddling action simulating exerciser in the form of a kayaking trainer as incorporating a seating and a footplate facility fitted to a spacer, in three dimensional view.
Figure 2:
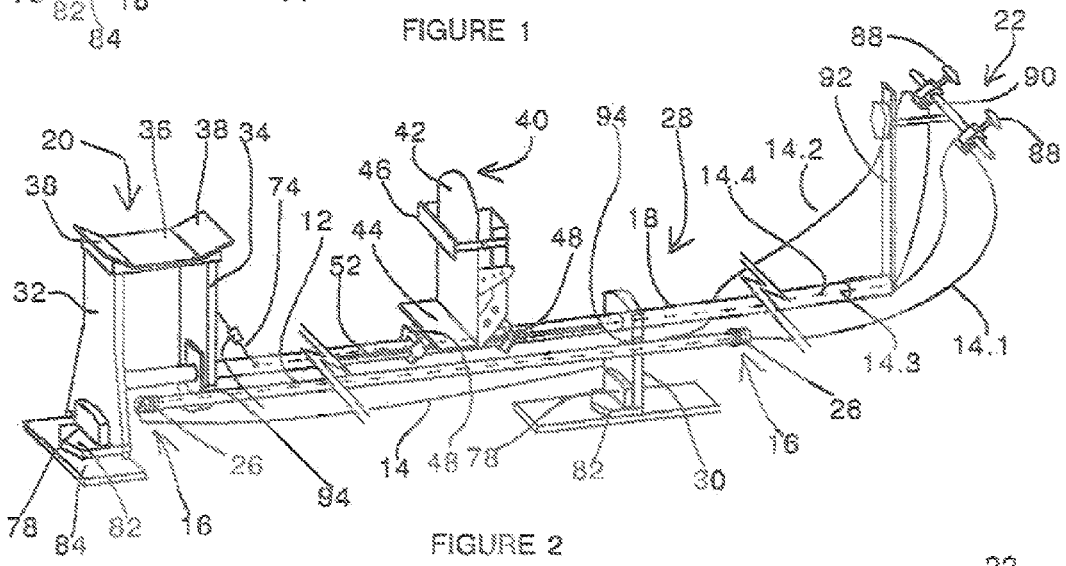
FIG. 2 shows the trainer of FIG. 1 in abbreviated spacer length view in more clearly showing its various parts.
Figure 3:
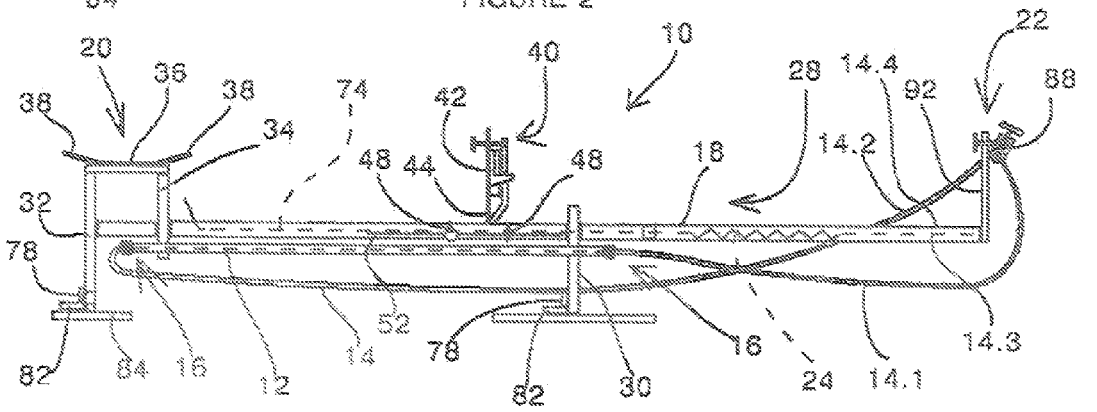
FIG. 3 shows the trainer in side elevation.

Referring to FIGS. 1 to 3 and 9 and 11 of the drawings a paddling action simulating exerciser in the form of a kayaking trainer is generally indicated by reference numeral 10.

The trainer 10 comprises a paddle action simulating formation in the form of a hollow open ended paddle simulating pole 12, a cord 14 that extends along the pole 12 in linearly displaceably passing there through while its opposite end lengths 14.1, 14.2 extend beyond the opposite ends 16 of the pole 12, a hollow spacer 18 extending between a sealing facility 20 and an anchoring layout including a cord guiding layout 22 along which the free ends 14.3, 14.4 of the cord 14 are secured to expansibly contractible resilient means in the form of a spring 24 extending within the spacer 18.

Figure 5:
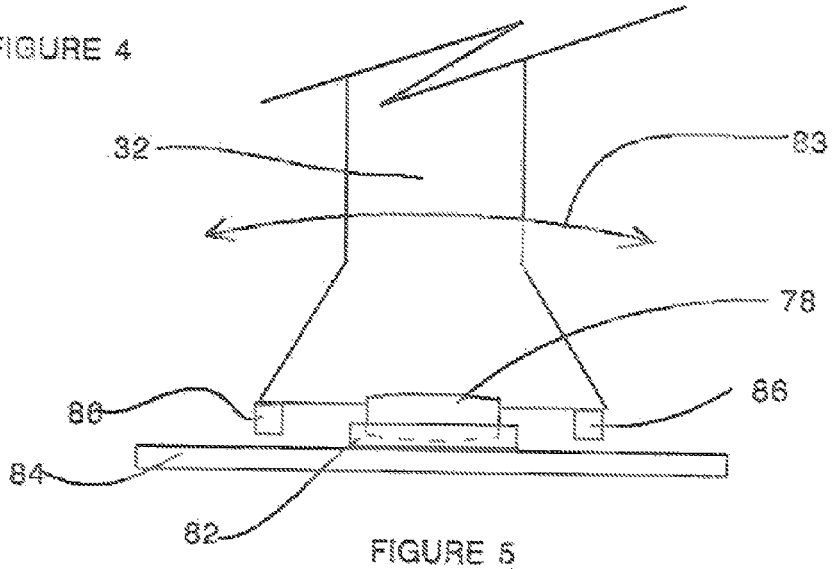
FIG. 5 shows the seating facility in the direction of arrow A in FIG. 4.
Figure 6:
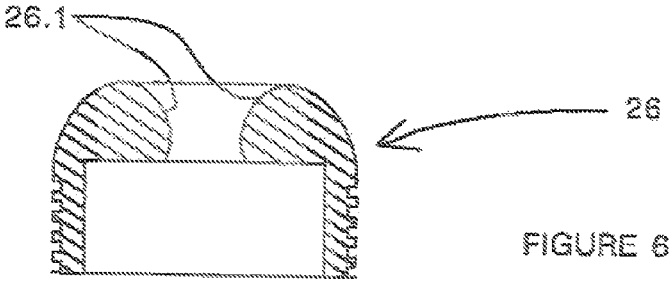
FIG. 6 shows a side elevational cross sectional detail of a bush as fitted to opposite ends of a paddle action simulating formation forming part of the trainer, FIG. 7 in three dimensional detail shows the footplate facility of the trainer.

The cord 14 passes against being damaged when subjected to linear displacement along the pole 12. The cord 14 under conditions of linear displacement along the pole 12 generate a factional resistive action in the pole 12 as being formed with reduced diameter opposite ends in the form of fitted bushes 26, detail of one being shown in FIG. 5, that accommodate the free though friction generating sliding of the cord 14 along the pole 12. As thus shown in FIG. 5, the bushes 26 present smooth curbed friction generating surfaces 26.1, typically in the fours of anodised surfaces. While not shown the pole 12 can also be fitted with one or more intermediate friction generating bushes.

Figure 4:
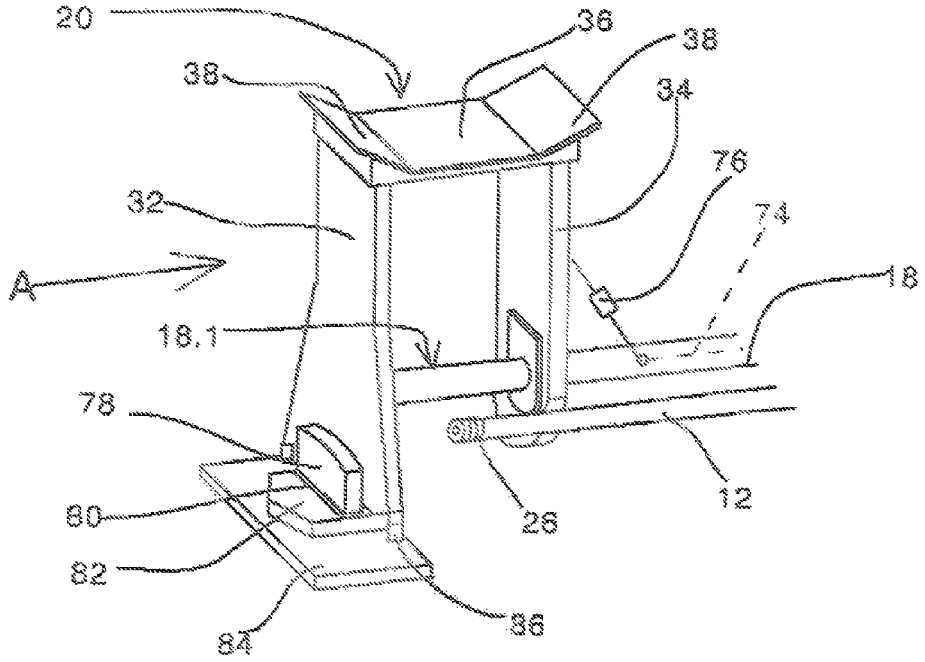
FIG. 4 shows in three dimensional detail the seating facility of the trainer.

The spacer 18 and seating facility 20 is fitted with elevating means in the form of an intermediate leg 30, on the one hand, and a seat elevating leg 32 forming part of the seating facility 20, on the other hand, for elevating the trainer 10 above a base in promoting the simulation of a kayak type paddling action. In also referring to FIGS. 4 and 5 the end region 18.1 of the spacer 18 engages with the seating facility 20 by passing along a bore in an inner seat supporting formation 34 while socketing securely to the leg 32. The seat 36 of the facility 20 is formed with leading and trailing end upward slanting sections 38 to promote a comfortable seating effect.

Figure 7:
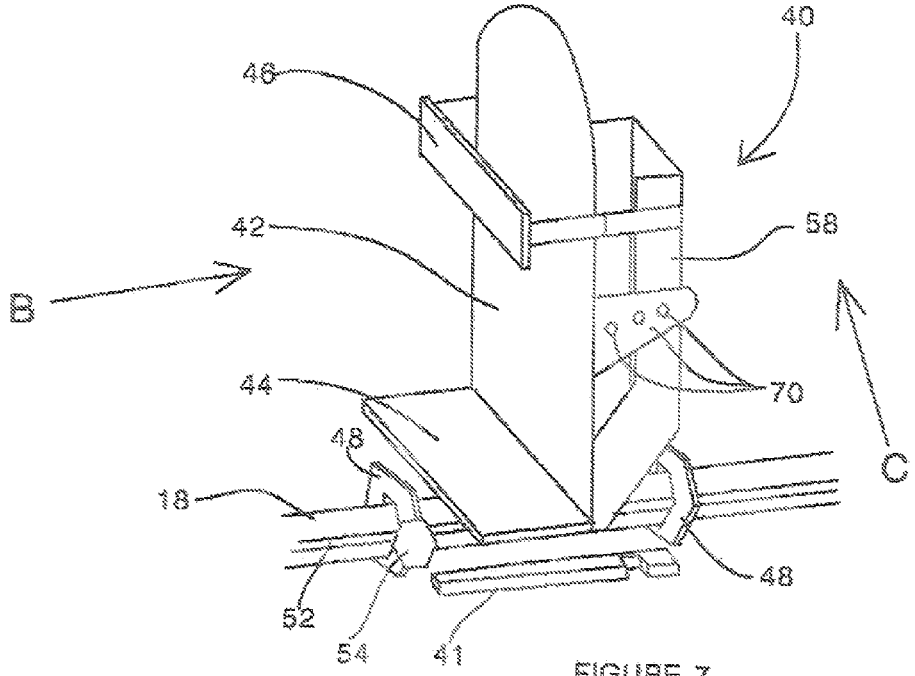
Figure 8:
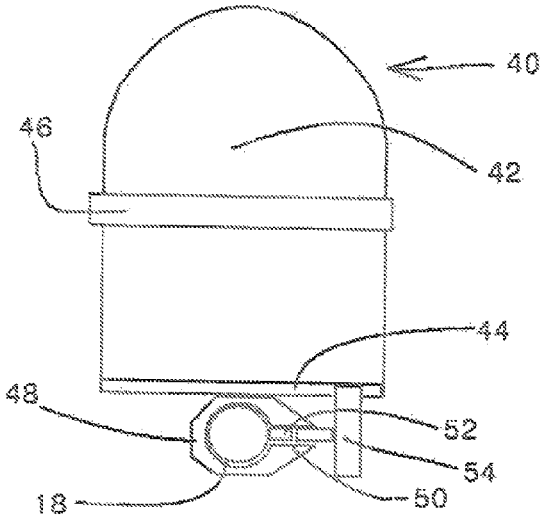
FIG. 8 shows the footplate facility in the direction of arrow B in FIG. 6.
Figure 9:
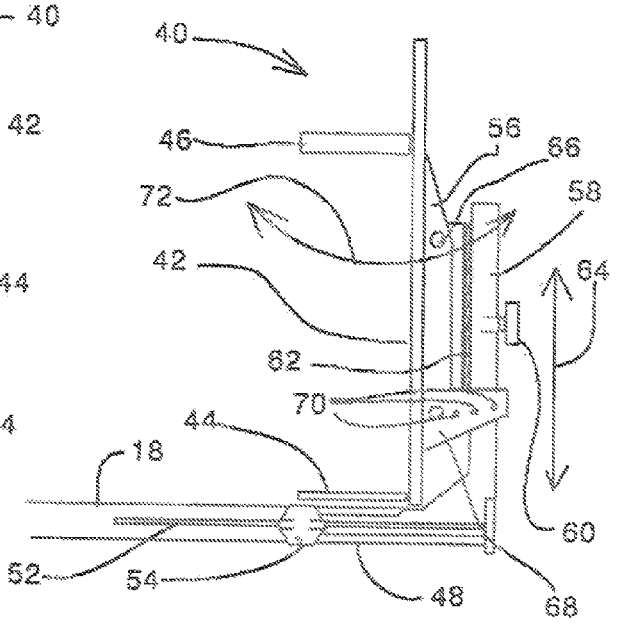
FIG. 9 shows the footplate facility in the direction of arrow C in FIG. 6 and thus in side elevation, FIG. 10 in diagrammatic side elevational view stepwise sets out the operation of the trainer, FIG. 11 in diagrammatic footplate facility facing view stepwise sets out the operation of the trainer, and FIG. 12 in diagrammatic overhead view stepwise sets out the operation of the trainer.

In also referring to FIGS. 7 to 9 the trainer 10 further incorporates a footplate facility 40 for the secure and comfortable holding of the feel of an exerciser user once seated on the seating facility 20. The facility 40 presents an upright foot abutment plate 42 fitted with a heel rest 44 and a toe strap 46. As more clearly shown in FIGS. 7 to 9 the facility 40 is multi-directionally adjustable. To this effect the facility 40 incorporates slider means by way of which the plate 42 fits slidably onto the spacer 18 by way of a circumferentially engaging leading and trailing sliders 48 each formed with a groove 50 along which a spacer fitted lengthwise key 52 engages. The trailing end slider 48 is fitted with a tightening grub 54 for securely clamping it to the spacer 18 at the desired location along the lengthwise spacing range of the facility 40 along the spacer 18. A lever 41, still shown in its unclamping condition, is used for transferring the clamping action of the grub 54 to the leading end slider 48 having the effect of simultaneously clamping the footplate facility 40 at opposite ends onto the spacer 18. The effect of such leading and trailing end clamping effect is to limit footplate facility movement during use of the trainer 10 that would otherwise have transpired owing to the considerable alternatingly left and right foot forces exerted on the footplate 42 during a training routine.

The spacer 18, seating facility 20, intermediate leg 30, footplate facility 40 and guiding layout 22 together form a trainer core assembly 28.

In addition to permitting slidable adjustment the foot abutment plate 42 in being fitted with the heel rest 44 and the toe strap 46 is also vertically as well as swivelable adjustable by way of a vertical adjustment mechanism. In referring more particularly to FIG. 9 the vertical adjustment mechanism involves the plate 42 being mounted to a back face bracket 56 that is in turn secured to the slider 48 via a complementing bracket 58 extending from the slider 48 by means of a releasable attachment clamp 60. In forming the bracket abutting faces with complementing undulations or ribs 62 the bracket 56 and thus the plate 42 is vertically adjustable in the direction of arrow 64 relative to the bracket 58 with the range as permitted by the complementing rib engagement.

As regards swivelable adjustment and staying with FIG. 9 a swivelling adjustment mechanism involves the plate 42 being swivelably mounted to the bracket 56 about swivelling locations 66 (of which the nearside one is shown). The bracket 56 is formed with arms 68 (again of which the nearside one is shown) each presenting a series of radially arranged spaced apertures 70 one of which is engageable with an aperture in the bracket 56. The plate 42 is thus swivelable in the direction of arrow 72 and lockable at the desired slope within the range of swivelling.

The extent of the paddling simulation effect as brought about by the frictional sliding of the cord 14 along the pole 12 and supplemented by the expansible retraction of the spring 24 within the spacer 18 once the trainer 10 is in use is adjustable by way of an adjusting mechanism involving an adjusting line 74 extending within the spacer 18 that extends from the end of the spring 24 remote from that to which the cord ends 14.3, 14.4 are secured. The end of the line 74 passes though the wall of the spacer 18 in close vicinity of the seating facility 20. The end region of the line 74 beyond its location of egress is fitted with a locking item 76 for adjustably holding the inner end of the spring 24 at a fixed spacing in relation to the seating facility 20. An increased tensioning effect on the spring 24 as brought about by its retraction by way of its inner end in the direction of the seating facility 20 by means of the line 74 has the overall effect of increasing a paddling simulating effort and vice versa.

The paddling action as performed a kayaking user involves a natural sideways rocking of the vessel. Such rocking effect is also incorporated in the design of the trainer 10. In again also referring to FIGS. 4 and 5 and to such effect the seating facility 20 and the intermediate leg 30 are formed with a rocking layout in the form of an arcuate bottom faced rocking formation 78 associated with each of the seating facility 20 and the leg 30 that each fits rockingly along a flat bottomed slot 80 extending laterally to the spacer 18 and formed within slot providing formations 82 respectively forming pad of the seating facility 20 and the intermediate leg 30. To limit hard impaction between the leg 32 and a base 84 during the performance of a rocking action the outer regions of the bottom edge of the leg 32 are fitted with resilient cushions 86 that come into yielding abutment with the base 84 during such rocking action.

The cord guiding layout 22 comprises cord end region supplementary friction generating means in the form of guide bushes 88 that are laterally adjustably fitted to a guide carrying rod 90 in turn fitted to a guide bush elevating formation 92 fitted to the end of the spacer 18 remote from the seating facility 20. The bushes 88 perform their supplementary friction generating effects once the trainer 10 is in use in the cord end regions 14.3, 14.4 sliding to-and-fro there along on tensioning and retraction of the spring 24.

The trainer 10 includes a pole storage facility as provided by pole accommodating notches 94 respectively formed within the leg 30 and the formation 34.

Figure 10:
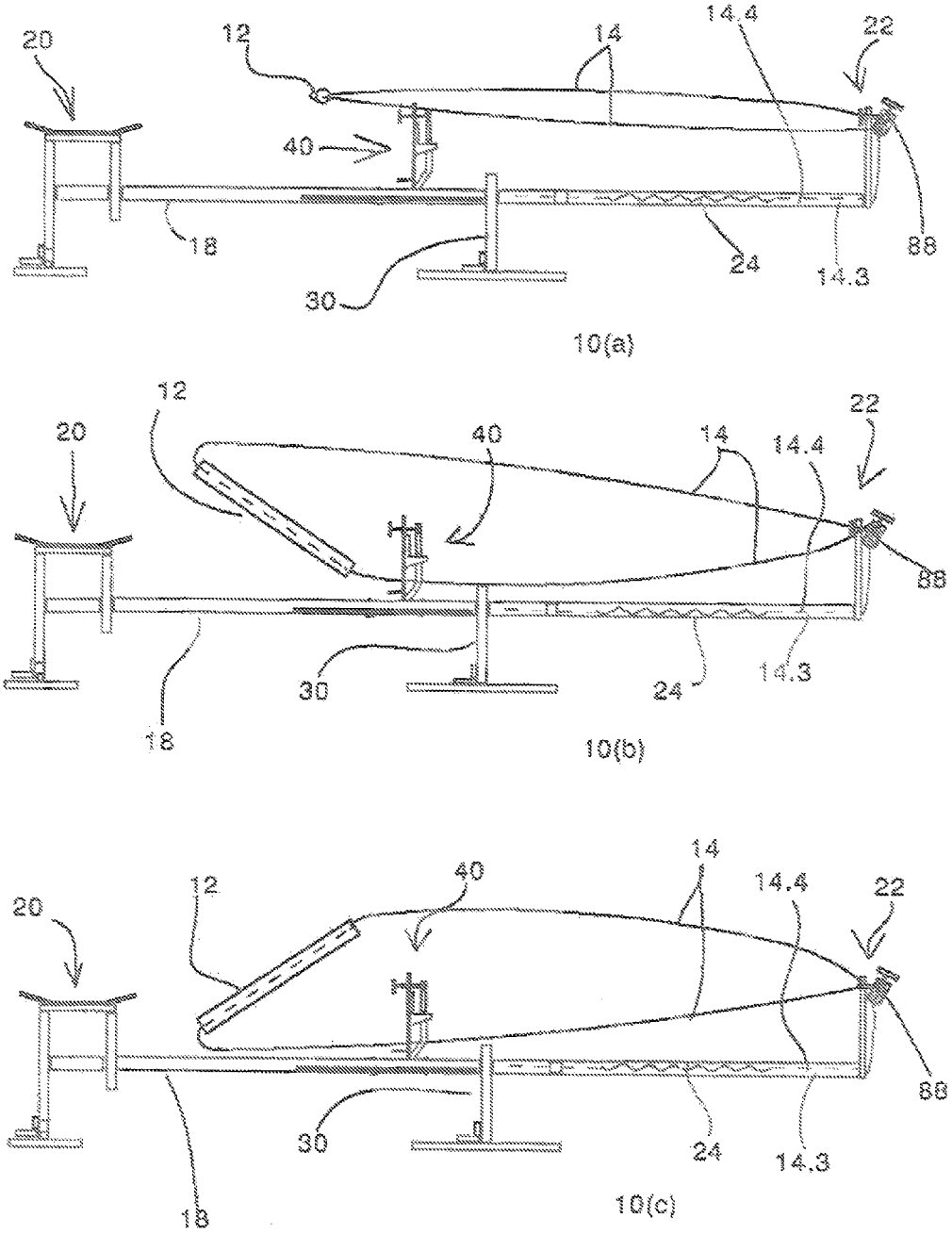
Figure 11:
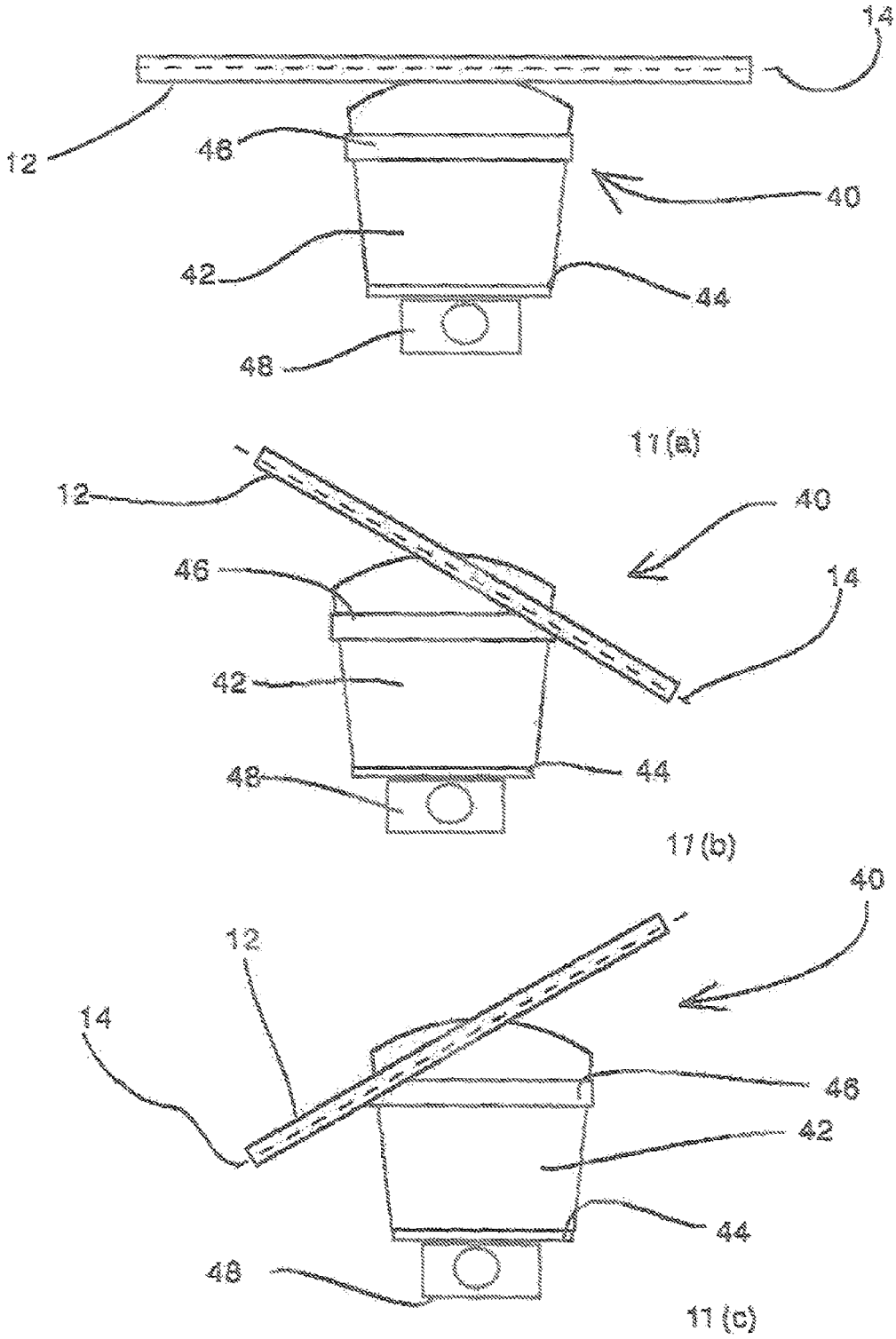
Figure 12:
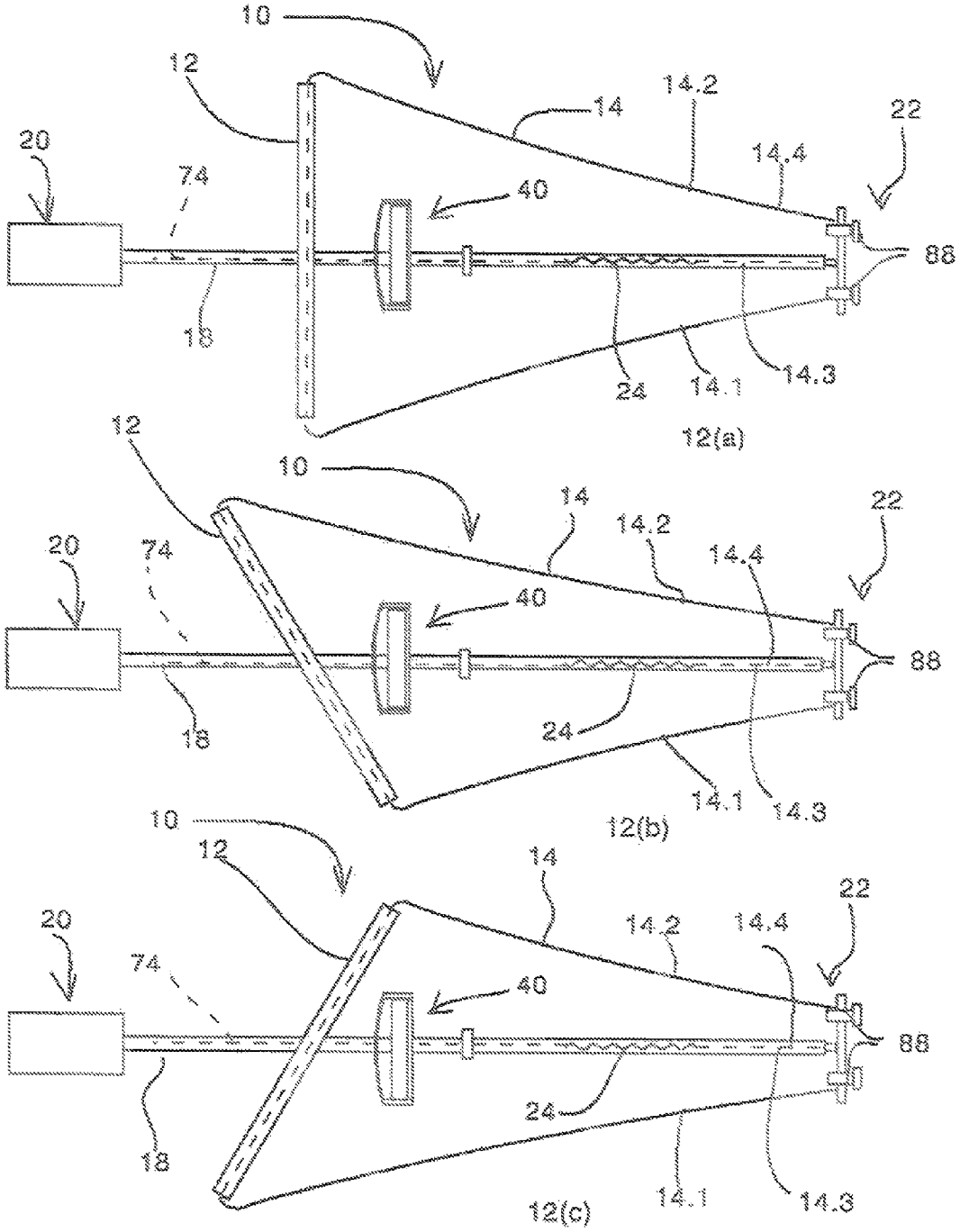

In preparing for use in performing a kayak simulating exercise and also referring to FIGS. 10 to 12 a trainer user once seated onto the seat 36 adjusts the footplate facility 40 to a comfortable setting as regards positioning along the spacer 18, vertical elevation and slope as described above. The extent of paddle simulating effort is also set by way of the line 74 as desirably tensionably setting the spring 24 with the aid of the locking item 76. The extent of paddle simulating effort can however also be set during the performance of the training routine as the location of egress of the end region of the line 74 is in close vicinity of the seating facility 20.

Once desirably set a kayak paddling simulating routine is done by performing a paddling action by way of the pole 12 that is thus conventionally kayak paddle fashion gripped by both hands about it centre with the pole 12 at the outset extending transverse to the spacer 18, as shown in FIGS. 10(*a*), 11(*a*) and 12(*a*). The paddling action simulating routine is performed in conventionally paddle action fashion moving the pole 12 as shown in FIGS. 10(*b*), 11(*b*) and 12(*b*) simulating a paddling effect along one side of the assembly 28 and FIGS. 10(*c*), 11(*c*) and 12(*c*) simulating a paddling effect along the opposite side of the assembly 28. During the performance such paddling effect simulation action the cord 12 is caused to linearly move to and fro along the pole 12 to accommodate the continuous variation in pole position in relation to the cord guiding layout 22. Such movement is accompanied by a friction effect on the movement of the cord 12 along the bushes 26 that simulate the drag on paddle end blades as conventionally forced through water.

During a conventional kayak paddling action the user of the equipment does not retain a stationary upper torso position within the equipment but also performs forward and rearward torso displacements. Similarly the user of the trainer 10 also performs forward and rearward torso displacements during a training routine. Such displacement actions alternatingly cause the free end regions 14.1, 14.2 of the cord 14 to by way of to-and-fro actions slide along the guide bushes 88 creating a supplementary friction effect in supplementing the friction effect of the cord along the pole 12. The to-and-fro movement of the opposite sections of the cord 12 are furthermore reflected in successive expansion and contraction cycles of the spring 24 that introduce successive relaxable tensioning actions that also supplement the friction generating effects of the cord 14 along the pole 12 bushes 88.

In simulating such conventional kayak paddling action the sideways rocking that is associated with an actual paddling action is accommodated by the rocking layout in response to the rocking effect of the lateral rocking formations 78 in their slots 80.

The overall effect of the friction in combination with the relaxable spring tensioning actions thus simulates the drag on paddle blades as urged along water during a conventional kayak paddling action having the overall effect of the trainer 10 being employable in a kayak paddling action simulating routine.

It is an advantage of the invention at least as specifically described that the trainer makes use of uncomplicated means in utilising the frictional effect of a sliding cord along a pole as supplemented by the extensible contraction of a spring to simulate a paddling effect through water while also simulating the natural rocking effect found in actual kayaking which enables trainer user to train such person's balancing skills away from a body of water.

The invention claimed is:

1. A paddling action simulating exerciser, comprising:

a paddle pole including a first end and a second end that is configured to simulate paddling action of at least one end region of a paddle;

a cord delimited between a first end and a second end and extending displaceably through at least part of a length of the pole and from at least one of the first end and the second end of the pole;

an anchoring assembly to which at least a portion of the cord extending beyond the pole is at least indirectly secured such that a tension is caused to tensionably extend up to and along the pole when the pole is held to simulate the paddling action by movement of the pole to-and-fro relative to the anchoring assembly; and a resilient element secured to at least one of the first end and the second end of the cord;

wherein linear displacement of the cord along the pole is resisted by the resilient element and by frictional resistance generated between the cord and the pole.

2. The paddling action simulating exerciser of claim 1, wherein the pole is an open ended hollow housing.

3. The paddling action simulating exerciser of claim 1, wherein the resilient element is at least one coil spring.

4. The paddling action simulating exerciser of claim 1, further comprising an adjusting mechanism and wherein the tensioning of the resilient element is adjustable by way of the adjusting mechanism.

5. The paddling action simulating exerciser of claim 1, wherein the cord extends substantially along at least the entire length of the pole and beyond both the first end and the second end of the pole to the anchoring assembly.

6. The paddling action simulating exerciser of claim 5, wherein the first end of the cord and the second end of the cord are both secured to the resilient element.

7. The paddling action simulating exerciser of claim 5, wherein the first end of the pole has a first opening and the second end of the pole has a second opening and the first opening of the first end and the second opening of the second end are both narrower in diameter than the opening extending within the pole so as to accommodate a frictional displacement of the cord as the cord slideably moves freely though the pole and beyond the first end and second end of the pole in a friction generating way.

8. The paddling action simulating exerciser of claim 5, further comprising a spacer and a seating assembly that is spaced from the anchoring assembly by the spacer with the cord and the pole being inter-arranged in relation to the seating assembly and the anchoring assembly.

9. The paddling action simulating exerciser of claim 8, further comprising an elevating assembly, wherein the spacer and the seating assembly are respectively fitted with the elevating assembly so that the spacer is arranged above a base of the exerciser.

10. The paddling action simulating exerciser of claim 9, wherein the elevating assembly includes a lateral rocking element to simulate a naturally occurring lateral rocking movement associated with kayaking.

11. The paddling action simulating exerciser of claim 10, wherein the lateral rocking element comprises arcuate bottom faced rocking elements fitted to flat bottomed slots extending laterally to the spacer.

12. The paddling action simulating exerciser of claim 8, wherein the spacer is a hollow element in which the resilient element is arranged with the first end and the second end of the cord being secured to the resilient element and arranged in the spacer from an end of the spacer opposite the seating assembly via the anchoring assembly with the spacer being open ended so that the cord is tensionably adjustable by movement of the resilient element while extending linearly along the spacer.

13. The paddling action simulating exerciser of claim 12, further comprising a cord assembly to which a first portion and a second portion of the cord are secured with the first end and the second end of the cord secured to the resilient element within the spacer.

14. The paddling action simulating exerciser of claim 13, wherein the cord assembly includes friction generating elements along which a first portion and a second portion of the cord extend.

15. The paddling action simulating exerciser of claim 8, further comprising a footplate assembly that is fixed to the spacer, between the seating assembly and the anchoring assembly for for placement of feet of a user.

16. The paddling action simulating exerciser of claim 15, wherein the footplate assembly is multi-directionally adjustable in attaining a desired seating and feet holding position for an exerciser user.

17. The paddling action simulating exerciser of claim 16, wherein the footplate assembly includes a slider assembly that is linearly slidable along the spacer and releasably lockably engage with the slider.

18. The paddling action simulating exerciser of claim 16, wherein the footplate assembly includes a vertical adjustment mechanism so as to be vertically adjustable.

19. The paddling action simulating exerciser of claim 16, wherein the footplate assembly includes a swiveling adjustment mechanism so as to be swivelably adjustable.

* * * * *